United States Patent [19]

Harris

[11] 4,122,004

[45] Oct. 24, 1978

[54] FROTH FLOTATION PROCESS

[75] Inventor: Guy H. Harris, Concord, Calif.

[73] Assignee: The Dow Chemical Company, Midland, Mich.

[21] Appl. No.: 849,280

[22] Filed: Nov. 7, 1977

Related U.S. Application Data

[63] Continuation-in-part of Ser. No. 754,765, Dec. 27, 1976, abandoned.

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,570,262 | 1/1926 | Kranzlein | 260/609 A |
| 2,352,435 | 6/1944 | Moeffelman | 260/609 R |
| 2,484,369 | 10/1949 | Ballard | 260/609 R |
| 2,522,589 | 9/1950 | Vaughan | 260/609 R |
| 2,536,684 | 1/1951 | Harman | 260/609 R |
| 2,657,238 | 10/1953 | Vaughan | 260/609 R |
| 3,081,354 | 3/1963 | Gaertner | 252/61 X |
| 3,555,390 | 7/1971 | Booth | 209/166 |
| 3,590,996 | 7/1971 | Harris | 209/166 |
| 3,855,751 | 12/1974 | Harris | 209/166 |

FOREIGN PATENT DOCUMENTS

| | | | |
|---|---|---|---|
| 1,355,091 | 12/1971 | United Kingdom | 209/166 |

*Primary Examiner*—Robert Halper

[57] ABSTRACT

A process for the recovery of mineral values by froth flotation in an aqueous medium from mineral ores with the use of an effective amount of a sulfide-containing polyalkylene oxide frother.

11 Claims, No Drawings

FROTH FLOTATION PROCESS

CROSS REFERENCE TO RELATED APPLICATION

The present application is a continuation-in-part of my co-pending application Ser. No. 754,765 now abandoned, filed Dec. 27, 1976.

BACKGROUND OF THE INVENTION

Froth flotation is a commonly employed process for concentrating minerals from ores. In a flotation process, the ore is crushed and wet ground to obtain a pulp. A frothing agent, usually employed with a collecting agent, is added to the ore to assist in separating valuable minerals from the undesired or gangue portions of the ore in subsequent flotation steps. The pulp is then aerated to produce a froth at the surface thereof and the collector assists the frothing agent in separating the mineral values from the ore by causing the mineral values to adhere to the bubbles formed during this aeration step. The adherence of the mineral values is selectively accomplished so that the portion of the ore not containing mineral values does not adhere to the bubbles. The mineral-bearing froth is collected and further processed to obtain the desired minerals. That portion of the ore which is not carried over with the froth, usually identified as "flotation tailings", is usually not further processed for extraction of mineral values therefrom. The froth flotation process is applicable to ores containing metallic and non-metallic mineral values.

In flotation processes, it is desirable to recover as much mineral values as possible from the ore while effecting the recovery in a selective manner, that is, without carrying over undesirable portions of the ore in the froth.

While a large number of compounds have foam or froth producing properties, frothers widely used in commercial froth flotation operations include polyalkylene glycol compositions and alkyl ethers thereof (see, for example, U.S. Pat. No. 3,595,390; 2,611,485 and 2,695,101). The frothers most widely used in froth flotation operations are compounds containing a non-polar, water-repellant group and a single, polar, water-avid group such as hydroxyl (OH). Typical of this class of frothers are mixed amyl alcohols, methylisobutyl carbinol (MIBC), hexyl and heptyl alcohols, cresols, terpinol, etc. Some effective frothers used commercially are the $C_1$–$C_4$ alkyl ethers of polypropylene glycol, especially the methyl ether and the polypropylene glycols of 140–2100 molecular weight and particularly those in the 400–1100 range.

Although mineral recovery improvements from a preferred frother in the treatment of an ore can be as low as only about 1 percent over other frothers, this small improvement is of great importance economically since commercial operations often handle as much as 50,000 tons of ore daily. With the high throughput rates normally encountered in commercial flotation processes, relatively small improvements in the rate of mineral recovery result in the recovery of additional tons of minerals daily. Obviously, any frother which promotes improved mineral recovery, even though small, is very desirable and can be advantageous in commercial flotation operations, especially in view of increasing energy costs.

It is an object of the present invention to provide frothing agents which improve the selective recovery of mineral values from ores. Further, it is an object of the present invention to provide frothing agents which can be satisfactorily employed in present flotation processes. Further objects of the present invention will become evident in view of the details set forth hereinbelow.

In accordance with the present invention, it has been found that, in a process for collecting mineral values from an ore which comprises mixing ground ore with water to form an ore pulp, aerating said pulp in the presence of a frothing agent, improved recovery results are obtained with sulfide-containing polyalkylene oxide compositions (hereinafter referred to as "frothers") of the formula:

$$H(BO)_z(PO)_y(EO)_xS(EO)_{x'}(PO)_{y'}(BO)_{z'}H$$

wherein, in said formula, EO = $C_2H_4O$, PO = $C_3H_6O$ and BO = $C_4H_8O$, $x$ and $x'$ each are 0–2, $y$ and $y'$ each are 0–7 and $z$ and $z'$ each are 0–2, $x+x'+y+y'+z+z'$ being an average of from 4 to about 14, with the proviso that at least one of $x$, $y$ or $z$ and at least one of $x'$, $y'$ or $z'$ is always at least 1 and with the further proviso that when $y$ and $y'$ are each 0, one of $z$ or $z'$ is always at least 1.

Those skilled in the art will recognize that, while pure compositions of the frothers herein can be obtained, it is difficult and prohibitively expensive to do so in many instances. Pure or substantially pure compositions as such are useful and within the scope of the present invention; however, reaction product mixtures containing mixed fractions of the same or different alkylene oxide moieties are desirably utilized as they are less costly. Thus, it will be readily apparent to those skilled in the art that the average or average sum of $x+x'+y+y'+z+z'$ refers to the average content of the alkylene oxide moieties per molecule in a given composition. The actual amount of each fraction may be the same or different and the average sum of alkylene oxide moieties per molecule in a given mixture can readily be determined. By way of illustration, a product mixture having an average PO moiety content of about 10 per molecule may be comprised of about equal amounts of frother fractions having average PO moiety contents of 6,10 and 14, respectively.

A preferred embodiment includes product composition mixtures of the above formula wherein $z$ and $z'$ are 0 and the average sum of $x+x'+y+y'$ is from 4 to about 14. In another preferred embodiment, $z$ and $z'$ are 0 and the average sum of $x+x'+y+y'$ is from 4 to about 10. In still another embodiment, $z$ and $z'$ are 0, $x+x'$ is an average sum of 1 to about 4 and $y+y'$ is an average sum of 1 to about 8. Also preferred are mixtures wherein $x$ and $x'$ and $z$ and $z'$ are all 0 and $y+y'$ is an average sum of from 4 to about 14. Additional preferred mixtures are those where $x$ and $x'$ and $z$ and $z'$ are all 0 and $y+y'$ is an average sum of from 4 to about 10. Another preferred class includes mixtures wherein $x$ and $x'$ and $z$ and $z'$ are all 0 and $y+y'$ is an average sum of from 4 to about 8. In an additional preferred embodiment, $x$ and $x'$ and $z$ and $z'$ are all 0 and $y+y'$ is an average sum of 7. In still another embodiment, $x$ and $x'$ and $z$ and $z'$ are all 0 and $y+y'$ is an average sum of 5. Another preferred mixture is where $z$ and $z'$ are zero, $x+x'$ represents an average sum of 2 and $y+y'$ represents an average sum of 4.

The frothers of the present invention are added to the ore and intimately mixed therewith either alone or together with a collector prior to and/or during the flotation step. The ore pulp-frother mixture is then treated under conditions to form a froth. The froth selectively removes the mineral values from the ore and the mineral-rich froth is separated from the ore flotation pulp and recovered. This value-depleted pulp which remains in the flotation cell is removed. The mineral-rich froth is then further treated to recover the desired mineral values. In accordance with the process of this invention it has been found that both the amount of mineral values which are recovered and the concentration of mineral values in the froth are substantially increased over prior processes which employ known frothers. These processing improvements are obtained with substantially the same or lower quantities of frothing agents as compared to those used currently in flotation operations. Accordingly, the present invention provides substantial advantages over prior processes.

The frothers of this invention can be employed in the flotation of metallic and non-metallic ores. Exemplary ores which are processed include sulfides and oxides of copper, molybdenum, lead, zinc, iron, nickel, cobalt, and the like. Such ores may also contain precious metal values. Other exemplary ores are phosphate rock, cement rock, glass sands, feldspars, fluorspars, micas, clays, talcs, coals and ores containing tungsten, manganese, sulfur, and water-soluble minerals such as sodium and potassium chlorides, and the like. The frothers of this invention are employed in amounts of from about 0.005 lbs. per ton ore to about 0.5 lb. per ton of ore; or preferably from about 0.01 lb. per ton ore to about 0.1 lb. per ton ore. Those skilled in the art will recognize that frother amounts will vary depending upon a given plant operation, ore type, etc., and that optimum amounts can readily be determined by mill trial runs. Preferably, the frothers of the present invention are employed in the recovery of copper or molybdenum, most preferably molybdenum.

The frothers of the present invention are prepared by methods known to the art, including block polymer preparation methods.

The frothers employed in the present invention may be prepared according to known methods. For example, the frothers can be prepared by bubbling sufficient quantities of hydrogen sulfide gas through a solution of the polyalkylene oxide reactant, i.e., ethylene oxide, 1,2- and 1,3-propylene oxide and 1,2- or 2,3-butylene oxide or mixtures of these reactants, depending upon the final product desired. The frothers can also be prepared by reacting a mixture from which $H_2S$ can be generated, e.g., sodium sulfide in methanol, with an ethylene-, propylene- or butylene-chlorohydrin reactant. The reaction is usually carried out in the presence of a catalyst, e.g., sodium or potassium hydroxide, at temperatures ranging from about 50° to about 225° C., and at pressures ranging from ambient to up to about 1000 or more psi. Larger chain, higher molecular weight frothers can also be prepared by further reacting frothers prepared by any of the above with additional quantities of the desired EO, PO or BO reactants and/or mixtures thereof under similar conditions as described. Additions of the EO, PO or BO reactants, including the chlorohydrins, can be carried out sequentially or concurrently with two or more of the reactants being added as a mixture.

The frothers useful in the present invention may best be characterized in terms of their molecular weights. Products of average molecular weight in the range of about 225 to about 950 are suitable for use as frothers with the range of about 250 to about 700 being preferred. The amounts of alkylene oxide or corresponding chlorohydrin reactants necessary to achieve the various compositions within the above-defined formula will be readily apparent to those skilled in the art, who will also recognize that the claim length is based on an average determination of EO, PO and BO moieties present.

The frothers of this invention can be employed either alone or in conjunction with standard frothers and with a conditioning agent or modifier and/or a water-soluble or oily collector or promoter. Suitable water-soluble collectors or promoters which can be employed in the flotation of sulfide or oxide metallic ores are alkali metal xanthates, sodium or potassium ethyl, isopropyl, secondary or isobutyl, amyl, or isoamyl and hexyl xanthates, alkyl thiols, and dithiophosphates such as dicresyl, diethyl, diisopropyl, disecondary or diisobutyl, diamyl or diisoamyl and dihexyl dithiophosphates as free acids or as sodium, potassium or ammonium salts, as well as mercaptobenzothiazole derivatives. Suitable oily collectors which can be employed with the frothers of this invention include dithiocarbamates such as S-allyl-N-ethyldithiocarbamate, S-allyl-N-isopropyldithiocarbamate and S-allyl-N-methyl-dithiocarbamate, as well as allyl/alkyl xanthate esters, dialkyl thionocarbamates and (alkoxycarbonyl)alkyl xanthates; these collectors are oil-soluble.

In the flotation of non-metallic ores, suitable water-soluble and oil-soluble collectors or promoters are oleic acid, crude and refined tall oil, and tall oil fatty acids, naphthenic acids, the sodium, potassium, and ammonium soaps of such acids, black liquor soap, petroleum sulfonates, organic phosphates and polyphosphates, sulfonated oils and fatty acids, sulfosuccinates and sulfosuccinamates. Cationic type collectors such as long chain amines or imidazolines are employed in the flotation of silica and silicates and water-soluble minerals.

Depending on the type of ore treated, conditioning or modifying agents such as alkalies and acids to adjust pH so as to improve selectivity, flotation depressants to inhibit the flotation of unwanted minerals, and activators to enhance flotability and improve flotation rates may be used with the frothers of this invention.

The following examples illustrate the process of the present invention and the superiority of the frothers over related oxygen analogs, but are not intended to limit the same.

EXAMPLE 1

Ground, hydrated sodium sulfide was dissolved in 300 ml of methanol and a small portion of propylene chlorohydrin was added thereto. No exotherm from the reaction temperature of 18° C. was observed. The reaction temperature was increased to about 50° C. and additional propylene chlorohydrin was added portionwise until a total of 189 grams had been added. The solvent was then stripped from the reaction mixture on a vacuum rotary evaporator, the residue was taken up in ether and the resulting mixture was washed with water and dried over $MgSO_4$. The ether and $MgSO_4$ were subsequently removed and the oily residue obtained was distilled. As a result of these operations there was obtained the desired product: $H(PO)_{y'}S(PO)_yH$ having a boiling point of 110°–112° at 1.5 mm of Hg, wherein the PO content $(y'+y)$ per molecule was 2.

EXAMPLE 2

A portion (18.4 grams) of the product obtained in Example 1 above having two PO groups per molecule was mixed with 0.1 gram of powdered KOH and 14 ml. of propylene oxide and the resulting reaction mixture was heated at about 150° C. for a period of about 2 hours. The product resulting from such operations was $H(PO)_yS(PO)_yH$ wherein the average PO content $(y+y')$ per molecule was about 4.

EXAMPLE 3

As in Example 2, 10.95 grams of the product from Example 1 above was reacted with 0.1 gram of powdered KOH and about 18.2 ml of propylene oxide to give a similar product wherein the average PO content $(y+y')$ per molecule in the mixture was about 5.

EXAMPLE 4

As in Example 2, 9.75 grams of the product obtained in Example 1 was reacted with 0.1 gram powdered KOH and 18.2 ml. of PO to give a similar product wherein the average PO content $(y+y')$ per molecule was about 6.

EXAMPLE 5

Employing 6 grams of the product of Example 1 having two PO groups per molecule with 0.1 gram powdered KOH and 22.4 ml of PO as in Example 2, a similar product having an average PO content $(y+y')$ per molecule of 10 was obtained.

EXAMPLE 6

About 7.95 grams of a previously prepared EO frother: H(EO)S(EO)H was reached with about 18.2 ml of propylene oxide and 0.1 grams of powdered KOH. The resulting reaction mixture was heated at about 150° C. for about 2 hours in a closed Carius tube. As a result of such operations the liquid product: $H(PO)_y(EO)S(EO)(PO)_yH$ wherein the two EO groups are attached to the sulfur atom and wherein the total average sum of $y+y'$ is about 4, was obtained.

EXAMPLE 7

A reaction mixture of powdered KOH (0.5 gram) and 2-mercaptoethanol is preheated to about 75° C. in a Parr bomb equipped with a stirrer and an internal cooling coil and an initial 18 g. of a mixture of ethylene oxide (29 g.)-propylene oxide (77 g.) is added portionwise thereto at a rate so that the reaction temperature does not exceed 150° C. The remainder of the mixture is subsequently added in portions and the resulting reaction mixture is heated at 150° C. for about 1 hour. The resulting product is $H(PO)_y(EO)_xS(EO)_x(PO)_yH$ wherein the total average sum of $x+x'$ is 2 and $y+y'$ is 4. This product is distinguished from the product obtained in Example 6 above in that the EO groups are not all directly attached to the sulfur atom. This example illustrates the random preparation of the frother polymers.

The foregoing examples illustrate typical procedures by which frothers employed in the invention can be prepared. Other frothers within the scope of the invention can be similarly prepared by the foregoing or other analagous methods known by those skilled in the art.

The following procedure and examples further illustrate the method of the present invention.

In typical frother evaluation methods known to those skilled in the art, 500 gram samples of ore is crushed to −10 U.S. Mesh and then further ground in a rod mill with 300 milliliters of distilled water until substantially all of the sample passes through a 65 U.S. Mesh screen. An initial amount of a collector is added to the resulting ground slurry along with a kerosene-fuel oil mixture and lime, the final adjusted pH for flotation being about 10.2.

The slurry from the rod mill was washed into a Denver-type flotation cell. The cell is operated at about 1800 rpm, with an automatic paddle operating at about 10 rpm, with air being metered into the cell at a rate of about 7.0 scfm. Frother is added to the slurry which is then conditioned for 2 minutes without air. The air is turned on and a first flotation concentrate is subsequently obtained as a result of 2 minutes flotation time. The air is then turned off and the first concentrate removed. Additional collector is added to the slurry along with additional frother and this concentrate is conditioned for 1 minute (without air) and then floated again (with air) for 2 minutes. This procedure is repeated, (but without removing the concentrate), giving a second combined (scavenger) concentrate which was floated for a period of 4 minutes. The concentrates and remaining tail are then analyzed; where two concentrates from the same trial are obtained, the results are totaled. Results obtained from separate trials with the test material are averaged.

EXAMPLE 8

Results, including the mixed frother agent, total amount used per ton and percent recovery of copper (Cu) and molybdenum (Mo) obtained from trials with an Arizona ore according to the above procedures, are set forth below in Table 1. A dialkyl thionocarbamate (0.012 lbs./ton) was used as a primary collector while sodium isopropyl xanthate (0.0015 lbs./ton) was used as a secondary collector.

TABLE I

| Run No. | Frother | lbs./ton | % Cu Recovery** | % Mo Recovery |
|---|---|---|---|---|
| (1) | MIBC* | 0.209 | 75.28 | 72.66 |
| (2) | (A) | 0.250 | 76.73 | 74.64 |
| (3) | (B) | 0.180 | 77.13 | 73.83 |
| (4) | (C) | 0.184 | 78.61 | 78.39 |

*Commercial frother agent - methylisobutyl carbinol.
**Total of two concentrates.
(A) $H(PO)_yS(PO)_yH$, $y+y'$ = average of about 4.
(B) $H(PO)_yS(PO)_yH$, $y+y'$ = average of about 5.
(C) $H(PO)_yS(PO)_yH$, $y+y'$ = average of about 6.

The results of the above trials indicate the frothers of the present invention are superior to the commercial frother MIBC widely employed in the industry.

EXAMPLE 9

In operations utilizing the procedures set forth above, a mixed frother agent was compared with the oxygen analog and the commercial MIBC product on a South American copper ore. The pH was 10.4 and a collector (isopropyl ethylthionocarbamate, 0.032 lbs./ton) was employed in the evaluations, the results of which are set forth below and reflect the average recovery values from two duplicate trials:

TABLE II

| Run No. | Frother | lbs./ton | Recovery % Cu | Recovery % Mo |
|---|---|---|---|---|
| 1. | A | 0.090 | 69.37 | 57.12 |

TABLE II-continued

| Run No. | Frother | lbs./ton | Recovery % Cu | Recovery % Mo |
|---|---|---|---|---|
| 2. | B | 0.085 | 65.27 | 55.68 |
| 3. | MIBC | 0.093 | 56.31* | 51.76 |
| 4. | A | 0.112 | 71.79 | 61.35 |
| 5. | B | 0.106 | 69.17 | 58.10 |
| 6. | MIBC | 0.116 | 65.62 | 60.18 |
| 7. | A | 0.157 | 74.55 | 64.77 |
| 8. | B | 0.148 | 73.30 | 63.26 |

A = $H(PO)_y(EO)_xS(EO)_x(PO)_yH$, average sum of $x+x'$ is about 2 and average sum of $y+y'$ is about 4.
B = $H(PO)_y(EO)_xO(EO)_x(PO)_yH$, average sum of $x+x'$ is about 2 and average sum of $y+y'$ is about 4.
C = MIBC - methylisobutylcarbinol.
*single trail only.

As compared with the oxygen analog B, frother (A) possessed superior frother properties in all trials, increases in Cu and Mo recovery of from at least 1 to as high as 4% for Cu and from 1½ to 3% for Mo. As compared with a commercially used frother, MIBC, the frother A was far superior, increases from 6–13% in Cu recovery and 1–5% in Mo recovery being obtained.

EXAMPLE 10

The procedures set forth above were repeated using a typical pH and collector and copper ores from two different sources (Ore #1 — Runs 1–5, Ore #2, Runs 6–8). An oxygen analog of a mixed frother and a commercial frother are also employed for comparative purposes. The results are set forth below in Table III:

TABLE III

| Run No. | Frother | lbs./ton | % Recovery Cu | % Recovery Mo |
|---|---|---|---|---|
| 1. | $H(PO)_yS(PO)_yH$ | .102 | 69.16 | 74.67 |
| 2. | $H(PO)_yO(PO)_yH$ | .094 | 67.42 | 63.40 |
| 3. | $H(PO)_yS(PO)_yH$ | .110 | 64.21 | 61.12 |
| *4. | $H(PO)_y(EO)_xS(EO)_x(PO)_yH$ | .112 | 68.09 | 67.30 |
| 5. | MIBC | .104 | 62.98 | 46.45 |
| 6. | $H(PO)_yS(PO)_yH$ | .132 | 73.65 | 68.55 |
| *7. | $H(PO)_y(EO)_xS(EO)_x(PO)_yH$ | .157 | 73.18 | 68.93 |
| 8. | MIBC | .139 | 65.09 | 56.01 |

Run Nos. 1 and 2, $y+y'$ is an average sum of about 6.
Run Nos. 3 and 6, $y+y'$ is an average sum of about 10.
Run Nos. 4 and 7, $y+y'$ is an average sum of about 4.
$x+x'$ is an average sum of about 2.
*Prepared as in Example 6.
MIBC = methylisobutyl carbinol.

The foregoing data indicate the frothers of the invention to be superior in frother properties at similar loadings over a commercial standard and the oxygen analog, especially in the recovery of Mo. In other operations, other frothers and mixtures thereof as herein defined are similarly found to possess good frother properties.

I claim:

1. In a process for collecting mineral values from an ore which comprises mixing ground ore with water to form an ore pulp and aerating said pulp in the presence of an effective amount of a frother, the improvement which comprises carrying out said process with a frother of the formula:

$$H(BO)_z(PO)_y(EO)_xS(EO)_{x'}(PO)_{y'}(BO)_{z'}H$$

wherein, in said formula, EO = $C_2H_4O$, PO = $C_3H_6O$ and BO = $C_4H_8O$, $x$ and $x'$ are each 0–2, $y$ and $y'$ each are 0–7 and $z$ and $z'$ each are 0–2, $x+x'+y+y'+z+z'$ being an average of from 4 to about 14, with the proviso that at least one of $x$, $y$ or $z$ and at least one of $x'$, $y'$ or $z'$ is always at least 1 and with the further proviso that when $y$ and $y'$ are each 0, of $z$ or $z'$ is always at least 1.

2. The process of claim 1 wherein the frother is employed with a mineral collector.

3. The process of claim 1 wherein $z$ and $z'$ are 0.

4. The process of claim 3 wherein the average sum of $x+x'+y+y'$ is from 4 to about 10.

5. The process of claim 3 wherein $x+x'$ is an average sum of from 1 to about 4 and $y+y'$ is an average sum of from 1 to about 8.

6. The process of claim 3 wherein $x$ and $x'$ are 0 and $y+y'$ represents an average sum of from 4 to about 14.

7. The process of claim 6 wherein the average sum of $y+y'$ is from 4 to about 10.

8. The process of claim 6 wherein $y+y'$ represents an average sum from 4 to about 8.

9. The process of claim 6 wherein $y+y'$ represents an average sum of 7.

10. The process of claim 6 wherein $y+y'$ represents an average sum of 5.

11. The process of claim 3 wherein $x+x'$ represents an average sum of 2 and $y+y'$ represents an average sum of 4.

* * * * *

UNITED STATES PATENT OFFICE

CERTIFICATE OF CORRECTION

PATENT NO. : 4,122,004

DATED : Oct. 24, 1978

INVENTOR(S) : Guy H. Harris

It is certified that error appears in the above-identified patent and that said Letters Patent are hereby corrected as shown below:

Column 4, line 6, delete "claim" and insert -- chain -- ;

Column 7, last line of Table II, delete "trail" and insert --trial --;

Column 8, line 23, last line of Claim 1, after "0," insert -- one -- .

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*